US006510291B2

(12) United States Patent
Campbell et al.

(10) Patent No.: US 6,510,291 B2
(45) Date of Patent: Jan. 21, 2003

(54) TONER SUPPLY WITH LEVEL SENSOR AND METER AND METHOD OF USING THE SAME

(75) Inventors: Alan Stirling Campbell, Lexington, KY (US); Jarrett Clark Gayne, Lexington, KY (US); William Dale Smith, Georgetown, KY (US)

(73) Assignee: Lexmark International, Inc, Lexington, KY (US)

( * ) Notice: Subject to any disclaimer, the term of this patent is extended or adjusted under 35 U.S.C. 154(b) by 0 days.

(21) Appl. No.: 09/838,353

(22) Filed: Apr. 19, 2001

(65) Prior Publication Data

US 2002/0154916 A1 Oct. 24, 2002

(51) Int. Cl.[7] ..... G03G 15/08
(52) U.S. Cl. ..... 399/27; 399/260; 399/263
(58) Field of Search ..... 399/27, 258, 260, 399/262, 263

(56) References Cited

U.S. PATENT DOCUMENTS

| | | | | |
|---|---|---|---|---|
| 1,765,622 | A | | 6/1930 | Schoen |
| 1,768,826 | A | | 7/1930 | Campbell |
| 2,317,274 | A | | 4/1943 | Johnson |
| 3,840,156 | A | | 10/1974 | Fujimoto |
| 4,277,003 | A | | 7/1981 | Tabuchi et al. |
| 4,452,174 | A | | 6/1984 | Fedder |
| 4,478,507 | A | | 10/1984 | Miyoshi et al. |
| 4,576,466 | A | | 3/1986 | Fukuchi et al. |
| 4,592,642 | A | | 6/1986 | Imaizumi et al. |
| 4,926,217 | A | | 5/1990 | Bares |
| 4,967,691 | A | * | 11/1990 | Chikama et al. ..... 399/258 X |
| 5,019,870 | A | | 5/1991 | Bares |
| 5,077,584 | A | | 12/1991 | Tanaka et al. |
| 5,257,076 | A | * | 10/1993 | Nishimura et al. ..... 399/27 |
| 5,287,151 | A | | 2/1994 | Sugiyama |
| 5,331,377 | A | | 7/1994 | Matsuura et al. |
| 5,561,506 | A | | 10/1996 | Kasahara |
| 5,583,622 | A | | 12/1996 | Nishimura |
| 5,614,994 | A | | 3/1997 | Kreiter |
| 5,652,947 | A | | 7/1997 | Izumizaki |
| 5,666,618 | A | | 9/1997 | Lee et al. |
| 5,669,046 | A | | 9/1997 | Yoshida et al. |
| 5,682,579 | A | | 10/1997 | Nomura et al. |
| 5,734,952 | A | | 3/1998 | Murakami et al. |
| 5,758,238 | A | | 5/1998 | Mordenga et al. |
| 5,761,584 | A | | 6/1998 | Tsuda et al. |
| 5,790,917 | A | | 8/1998 | Takura et al. |
| 5,822,653 | A | | 10/1998 | Ishii |
| 5,835,828 | A | | 11/1998 | Jyoroku |

* cited by examiner

*Primary Examiner*—Fred L. Braun
(74) *Attorney, Agent, or Firm*—David D. Kalish

(57) ABSTRACT

A device and method for storing toner within an image forming apparatus having an upper reservoir and a lower reservoir. A sensor paddle is positioned within the lower reservoir for determining a toner level within the lower reservoir. The sensor paddle rotates within an angular displacement from a fall point to a toner rest point. The device and method further includes a drive gear for rotating the sensor paddle, and a cam mechanism positioned adjacent to the drive gear. The cam mechanism is connected to the sensor paddle and has a cam angular displacement relative to the drive gear about equal to the sensor paddle angular displacement. A pawl having at least one opening is mounted on at least one post extending axially outward from the drive gear and includes a boss positioned within the cam track. Upon a predetermined angular displacement of the sensor paddle, the boss moves along the cam track resulting in the pawl radially extending outward from the drive gear and contacting a toner supply mechanism for transferring toner from the upper reservoir to the lower reservoir.

50 Claims, 9 Drawing Sheets

TONER SUPPLY WITH LEVEL SENSOR AND METER AND METHOD OF USING THE SAME

BACKGROUND OF THE INVENTION

1. Field of the Invention

The present invention is directed to an image forming apparatus and, more particularly, to an image forming apparatus having a toner level sensor and meter for moving toner from an upper toner supply reservoir to a lower supply reservoir.

2. The Prior Art

Image forming devices including copiers, laser printers, facsimile machines, and the like, include a photoconductive drum (hereinafter photoconductor) having a rigid cylindrical surface that is coated along a defined length of its outer surface. The surface of the photoconductor is charged to a uniform electrical potential and then selectively exposed to light in a pattern corresponding to an original image. Those areas of the photoconductive surface exposed to light are discharged thus forming a latent electrostatic image on the photoconductive surface. A developer material, such as toner, having an electrical charge such that the toner is attracted to the photoconductive surface is used for forming the image. The toner is stored in a reservoir adjacent to the photoconductor and is transferred to the photoconductor by the developer roll. The thickness of the toner layer on the developer roll is controlled by a nip, which is formed between the doctor blade and the developer roll. A recording sheet, such as a blank sheet of paper, is then brought into contact with the discharged photoconductive surface and the toner thereon is transferred to the recording sheet in the form of the latent electrostatic image. The recording sheet is then heated thereby permanently fusing the toner to the sheet.

The toner reservoir is normally located within a cartridge that is removably mounted within the image forming device. Once the toner within a cartridge has been used, the cartridge is removed from the image forming apparatus and replaced with one having a new supply of toner. One of the primary factors affecting the cost per page of printing in an image forming apparatus is the capacity of the toner in the cartridge. A toner reservoir that is too small such that it does not contain an adequate supply of toner requires continual replacement which adds expense due to purchasing new cartridges and becomes frustrating to a user who is repetitively shutting down the image forming apparatus to replace the cartridge. However, if the toner reservoir is too large, the pressure of the toner entering the doctor blade nip is too high, and objectionable vertical streaks are produced on the recording sheet.

Another consideration in the design of the toner reservoir is the desire to produce an image forming device having the smallest possible dimensions. This is a key selling point to consumers who desire the small dimensions because the apparatus are easier to manipulate and move, and occupy a minimal amount of desk space in a workstation where available space if often at a premium. To reduce the dimensions, the toner cartridges are often configured around the other components of the image forming apparatus. One design features a more vertically-aligned reservoir having the toner stored vertically above the doctor blade. This design takes advantage of the available space required for the focal distance required by the laser printheads. Although this increases the capacity of the toner, the design results in excessive toner pressure on the doctor blade nip resulting in poor quality images.

Thus, there remains a need for a large capacity toner reservoir that does not place an excessive amount of pressure on the doctor blade nip and does not necessitate a large image forming device.

SUMMARY OF THE INVENTION

The present invention provides for a toner reservoir having adequate toner amounts for creating numerous printed images without placing undesirable pressure on the doctor blade nip resulting in printing errors and defects. The toner reservoir is divided into an upper sump region that contains a majority of the toner and a lower sump region. The lower sump holds enough toner to ensure adequate toner is supplied to the photoconductor resulting in good print quality. As the toner within the lower sump is used in the printing process, additional toner is transferred from the upper sump region.

A toner sensor mechanism is positioned within the lower sump region for continuously monitoring the toner amount. The toner sensor mechanism includes a sensor paddle that rotates within the lower sump and has an angular displacement relative to the amount of toner within the lower sump. When the lower sump region contains an adequate toner amount, the angular displacement is small. When the lower sump has a low toner level, the angular displacement is large resulting in additional toner being supplied to the lower sump.

In one embodiment, the invention includes a toner supply mechanism and toner metering mechanism for supplying toner from the upper sump region to the lower sump region. Both mechanisms are connected via gears to the toner sensor mechanism. The toner supply mechanism includes a dual gear structure having a paddle that extends through the upper sump region for agitating and moving the toner. The metering mechanism includes a metering unit positioned between the lower and upper sump regions for transferring a specific amount of toner. Upon a large angular displacement by the sensor paddle, the gears of the toner supply and metering mechanisms are engaged and transfer a specific amount of toner into the lower sump to allow for continuous printing. This process repeats until all the toner within the upper and lower sumps is depleted.

DESCRIPTION OF THE PREFERRED EMBODIMENT

Figure 1:
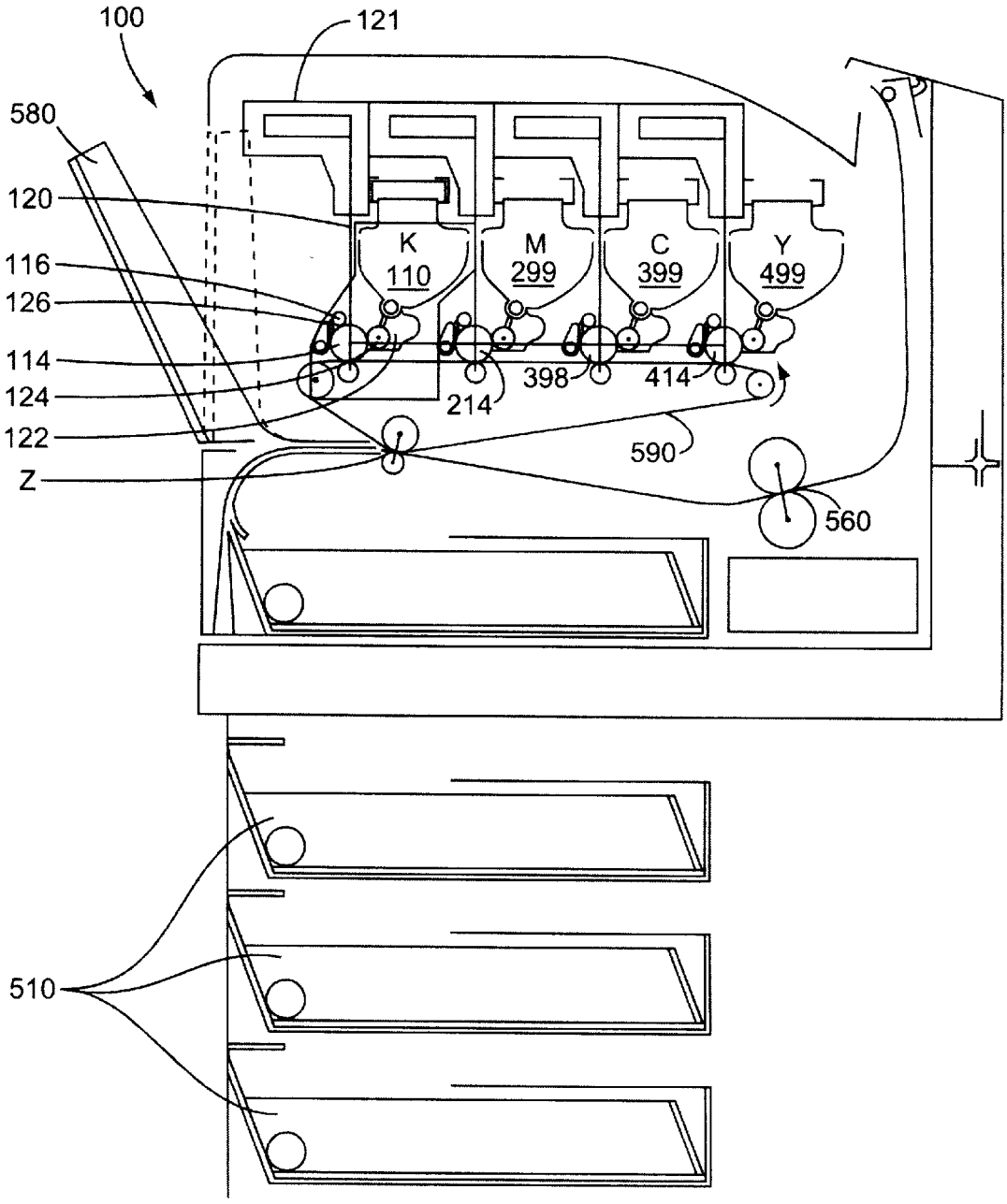
FIG. 1 is a side cut-away view illustrating the elements of an image-forming apparatus.

FIG. 1 illustrates the basic elements of an image forming apparatus and is incorporated for an understanding of the overall electrophotographic image forming process. A four cartridge color laser printer is illustrated as 100, however one skilled in the art will understand that the present invention is applicable to other types of image forming devices using toner for printing with a photoconductor. The image forming apparatus, generally designated 100, includes a plurality of similar toner cartridges 110, 299, 399, and 499. Each toner cartridge is of a similar construction but is distinguished by the toner color contained therein. In the preferred embodiment, the device includes a black (K) cartridge 110, a magenta (M) cartridge 299, a cyan (C) cartridge 399, and a yellow (Y) cartridge 499. Each different color toner forms an individual image of a single color that is combined in layered fashion to create the final multi-colored image.

Each of the toner cartridges is substantially identical and includes a photoconductor, a developer device, and a cleaning device. As the cartridges are identical except for the toner color, the cartridge and elements for forming black images will be described, with the other color image forming units being omitted for simplification.

The photoconductor 114 next rotates past an adjacently-positioned intermediate transfer mechanism belt 590 (hereinafter, ITM belt) to which the toner is transferred from the photoconductor 114. As illustrated in FIG. 1, the ITM belt 590 is endless and extends around a series of rollers adjacent to the photoconductors. The ITM belt 590 and each photoconductor 114, 214, 398, 414 are synchronized providing for the toner from each photoconductor to precisely align on the ITM belt 590 during a single pass. By way of example as viewed in FIG. 1, the yellow toner will be placed on the ITM belt, followed by cyan, magenta, and black.

Figure 4:
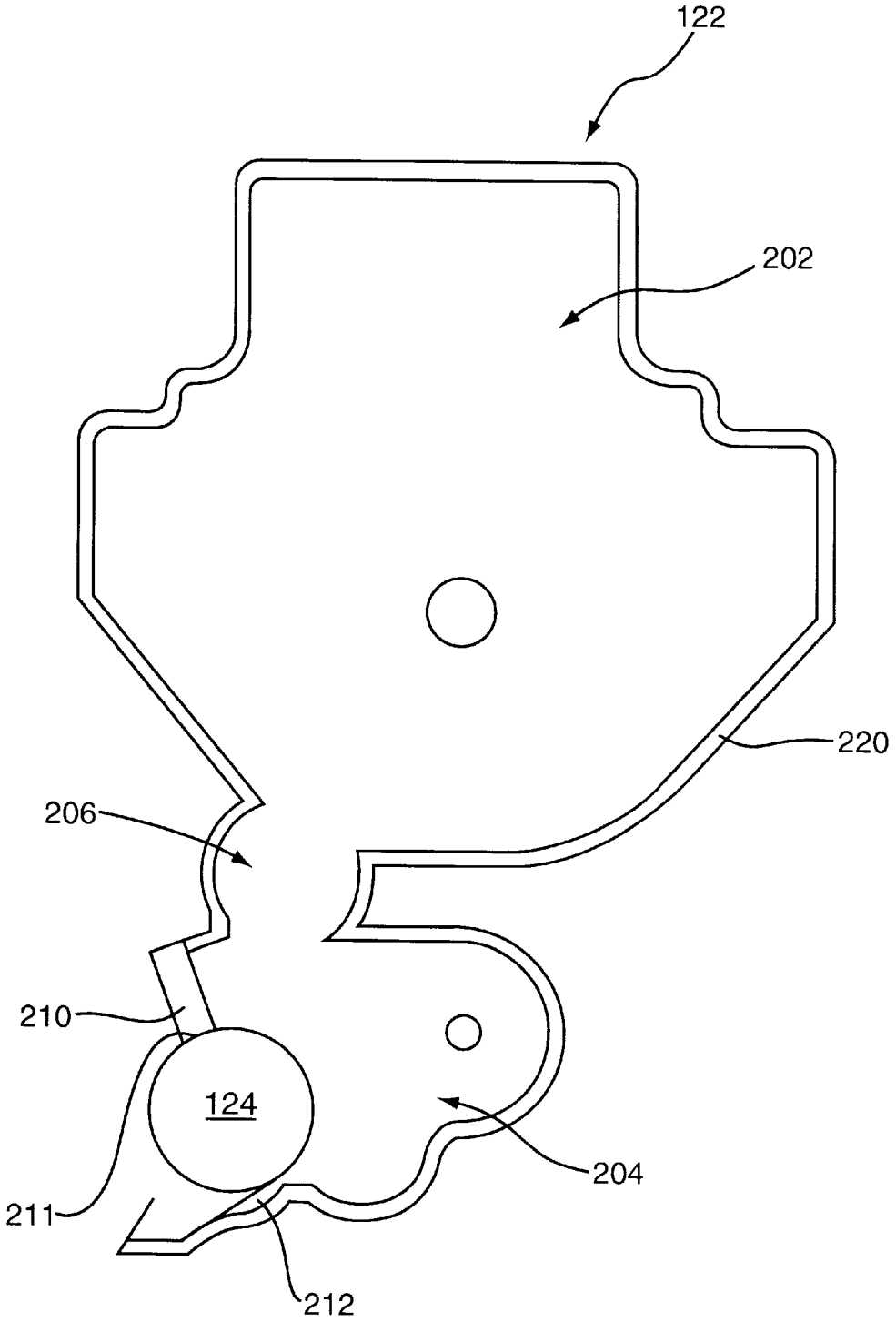
FIG. 4 is a cross section view of the toner reservoir constructed according to the present invention.

After receiving the latent image, the photoconductor 114 rotates to the developer which has a toner bin, illustrated generally as 122 in FIG. 1 and specifically as 204 in FIG. 4, for housing the toner and a developer roller 124 for uniformly transferring toner to the photoconductor. The toner is transferred from the toner bin 204 to the photoconductor 114 through a doctor blade nip 211 formed between the developer roller 124 and the doctor blade 210. The toner is a fine powder usually constructed of plastic granules that are attracted and cling to the areas of the photoconductor 114 that have been discharged by the laser scanning assembly 120.

The photoconductor 114 next rotates past an adjacently-positioned intermediate transfer mechanism belt 500 (hereinafter, ITM belt) to which the toner is transferred from the photoconductor 114. As illustrated in FIG. 1, the ITM belt 500 is endless and extends around a series of rollers adjacent to the photoconductors. The ITM belt 500 and each photoconductor 11 4, 214, 314, 414 are synchronized providing for the toner from each photoconductor to precisely align on the ITM belt 500 during a single pass. By way of example as viewed in FIG. 1, the yellow toner will be placed on the ITM belt, followed by cyan, magenta, and black.

After depositing the toner on the ITM belt, the photoconductor 114 rotates through a cleaning area where residual toner is removed from the surface via a brush or scraper 126. The residual toner is moved along the length of the photoconductor 114 to a waste toner reservoir 109 where it is stored until the cartridge is removed from the image forming apparatus and disposed. In one embodiment, the photoconductor 114 further passes through a discharge area (not shown) having a lamp or other light source for exposing the entire photoconductor surface to light to remove any residual charge and image pattern formed by the laser.

As the photoconductors are being charged and gathering toner, a recording sheet, such as a blank sheet of paper, is being routed to intercept the ITM belt 590. The paper may be placed in one of the lower trays 510, or introduced into the image forming device through a side track tray 580. A series of rollers and belts transport the paper to point Z where the sheet contacts the ITM belt 590 and receives the toner. The sheet may receive an electrostatic charge prior to contact with the ITM belt to assist in attracting the toner from the belt. The sheet and attached toner next travel through a fuser 560 having a pair of rollers and a heating element that heats and fuses the toner to the sheet. The paper with fused image is then transported out of the printer for receipt by a user.

Each of the toner cartridges may be removed and replaced within the image forming apparatus. Replacement is usually necessary when there is no toner remaining within the cartridge. In an embodiment as illustrated in FIG. 1, the cartridges are side loading into the image forming device in a direction substantially perpendicular to the rotation of the ITM belt 590.

Figure 2:
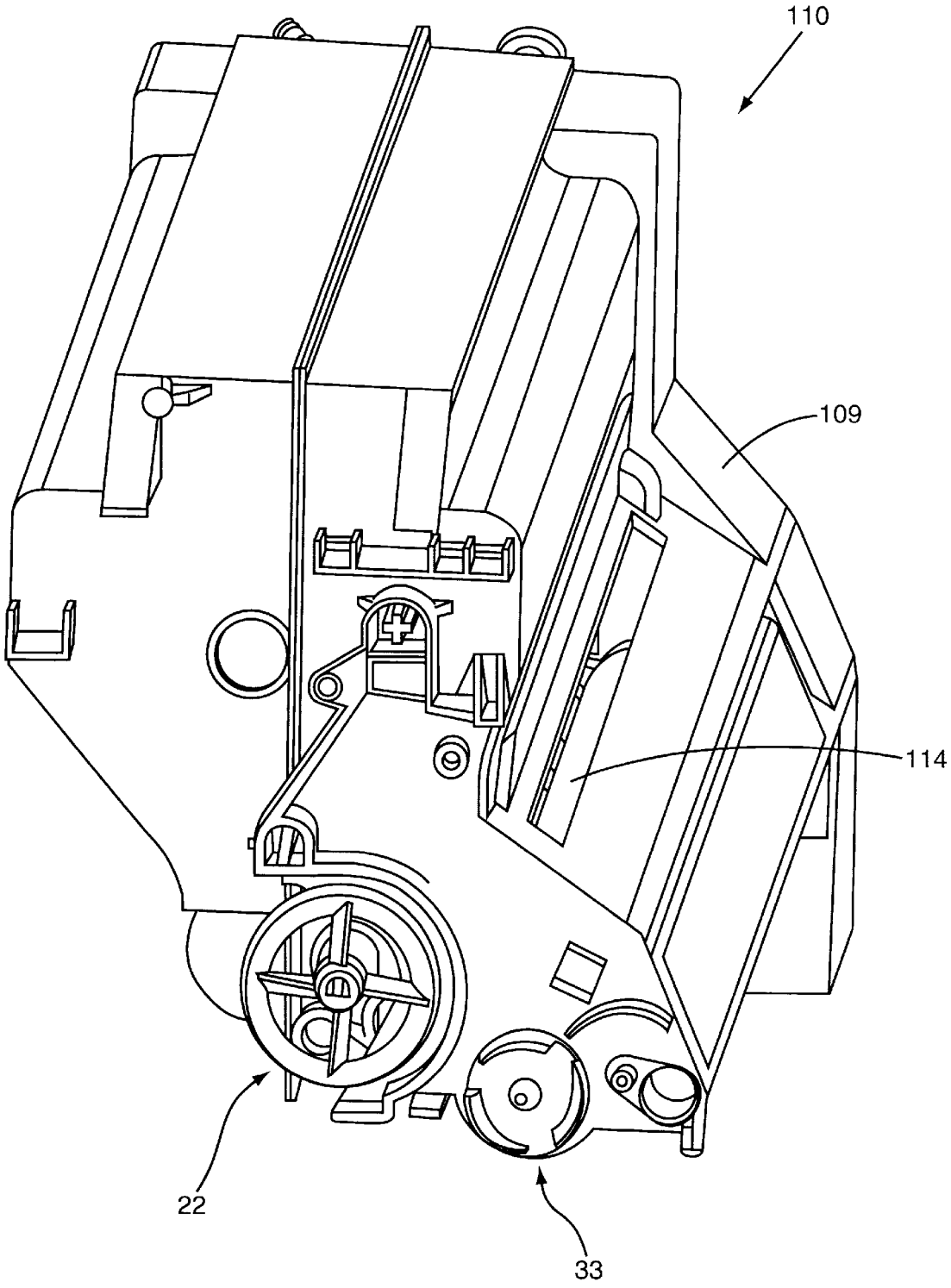
FIG. 2 is a perspective view illustrating the back side of a printer cartridge constructed according to the present invention.

FIG. 2 illustrates a rear view of a toner cartridge 110. The photoconductor 114 is positioned within the cartridge and includes a coupler 33 positioned on one end which intermeshes with the drive gears of the printer (not shown) for rotating the photoconductor 114 during the printing process. A second coupler 22 is also positioned on the back end of the cartridge and intermeshes with printer drive gears for agitating and moving the toner within the toner reservoir to contact the developer roller 124 for high quality printing. If the toner is not agitated and moved within the toner reservoir, the toner may become stuck within the reservoir requiring a new cartridge to be loaded into the printer. Alternatively, the toner may become blocked within the reservoir resulting in an inadequate amount of toner being transferred to the developer roller 124 and photoconductor 114 causing light or vague images to be printed, or worse, blank pages. In one embodiment, the toner cartridge 110 is side loading within the printer for easy installation and removal.

Figure 3:
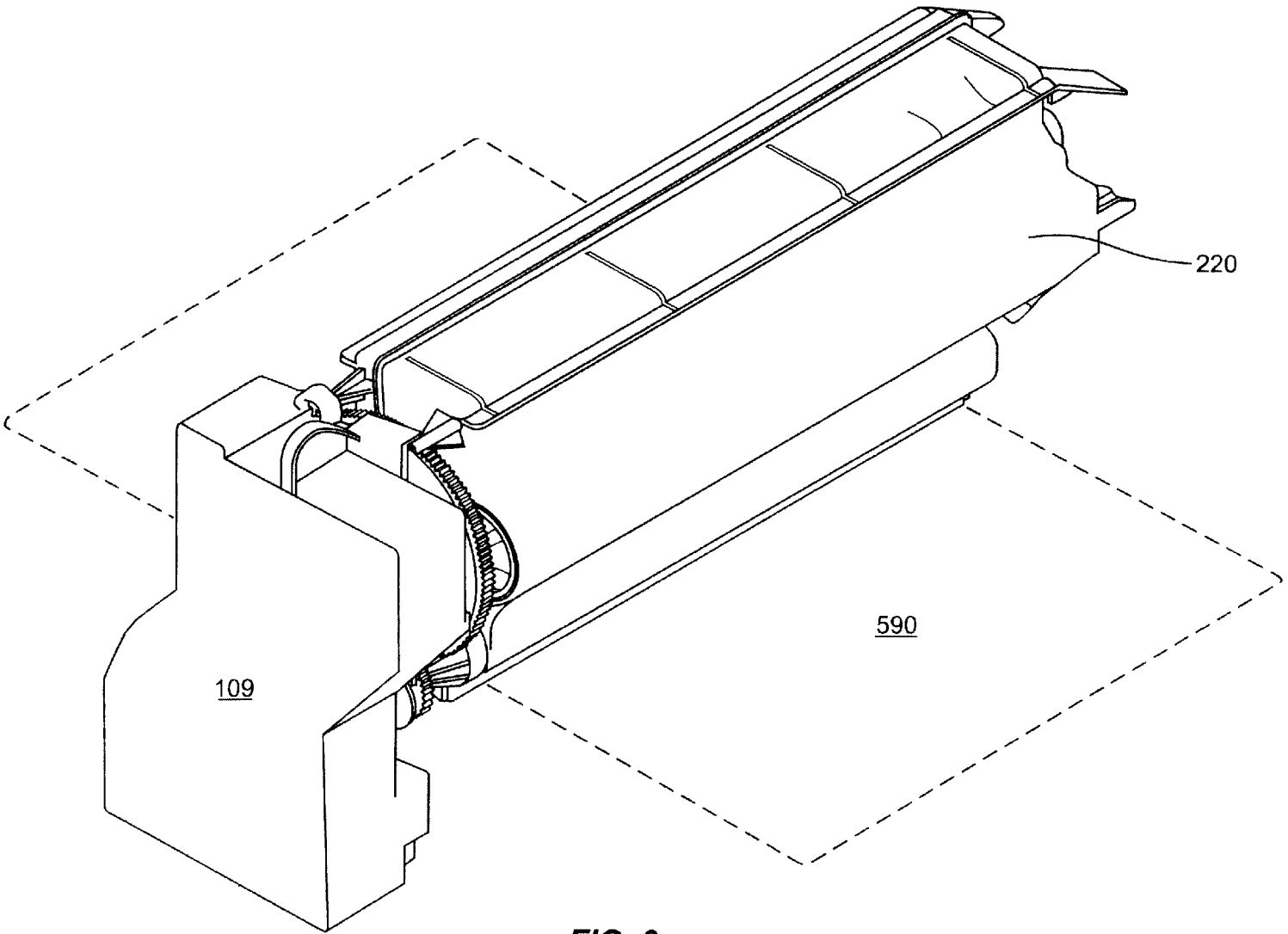
FIG. 3 is a partial perspective view of the printer cartridge positioned relative to the intermediate transfer belt.

The front end of the cartridge is illustrated in FIG. 3. The ITM belt 590 is placed in the drawing to illustrate the relative spacing and positioning of the cartridge within the printer. A toner bin housing 220 extends around the toner reservoir for containing the toner and preventing leakage that could result in print errors or come in contact with the user.

Toner is housed within the cartridge in a toner bin or toner supply reservoir 122 as illustrated in FIG. 4. The amount of toner stored within the cartridge is critical because a larger toner amount allows for more images to be produced before the toner is emptied and the cartridge is removed. However, a toner reservoir that is too large requires too much room within the printer 100 resulting in a large overall printer size. The toner reservoir 122 includes an upper sump area 202 and a lower sump area 204. A pass through region 206 is positioned between the upper and lower sump regions and provides a path for toner to move from the upper sump 202 to the lower sump 204. The lower sump area 204 includes the developer roller 124 for transferring toner to the photoconductor 114. A doctor blade 210 is positioned in contact with the developer roller 124 for controlling the amount of toner developed to the photoconductor 114. The doctor blade 210 preferably forms an outer edge of the lower sump region 204 as illustrated in FIG. 4, however, the doctor blade may be contained within the walls of the lower sump region. A seal 212 extends from the edge of the lower sump region to the developer roller 124 to prevent toner leakage.

The upper sump region 202 holds a larger amount of toner than the lower sump region 204. This provides for a larger overall volume of the toner reservoir 122 without placing pressure on a doctor blade nip 211 formed between the doctor blade 210 and the developer roller 124. If too much toner is positioned against the doctor blade 210, inconsistent amounts of toner may be transferred from the developer roller 124 to the photoconductor 114 resulting in poor print quality and print errors. Isolating the lower sump region 204 from the larger amount of toner contained in the upper sump region 202 controls the amount of pressure on the opening between the doctor blade 210 and developer roller 124 and reduces or eliminates print errors caused by excessive toner passing between the doctor blade 210 and developer roller 124. The upper sump region 202 may be positioned vertically above the lower sump region 204. This provides for gravity to assist in moving the toner from the upper sump region 202 to the lower sump region 204. This orientation also provides for the toner reservoir to be positioned within cartridge space required for the focal distance between the laser printhead 121 and the photoconductor 114.

Figure 5:
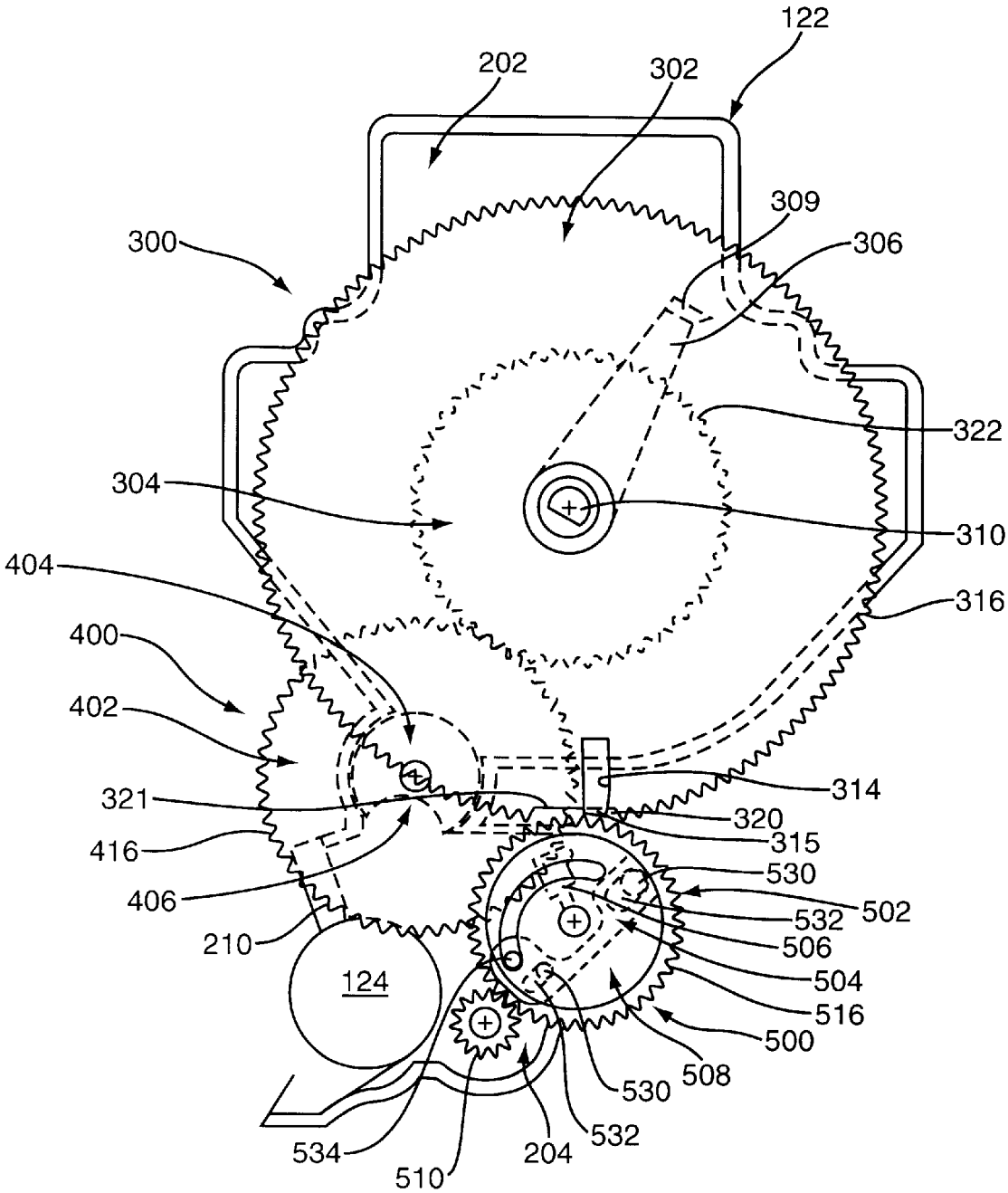
FIG. 5 is an end view of the toner reservoir and gear mechanisms for sensing the amount of toner within the lower reservoir and transferring toner from the upper reservoir to the lower reservoir.
Figure 6:
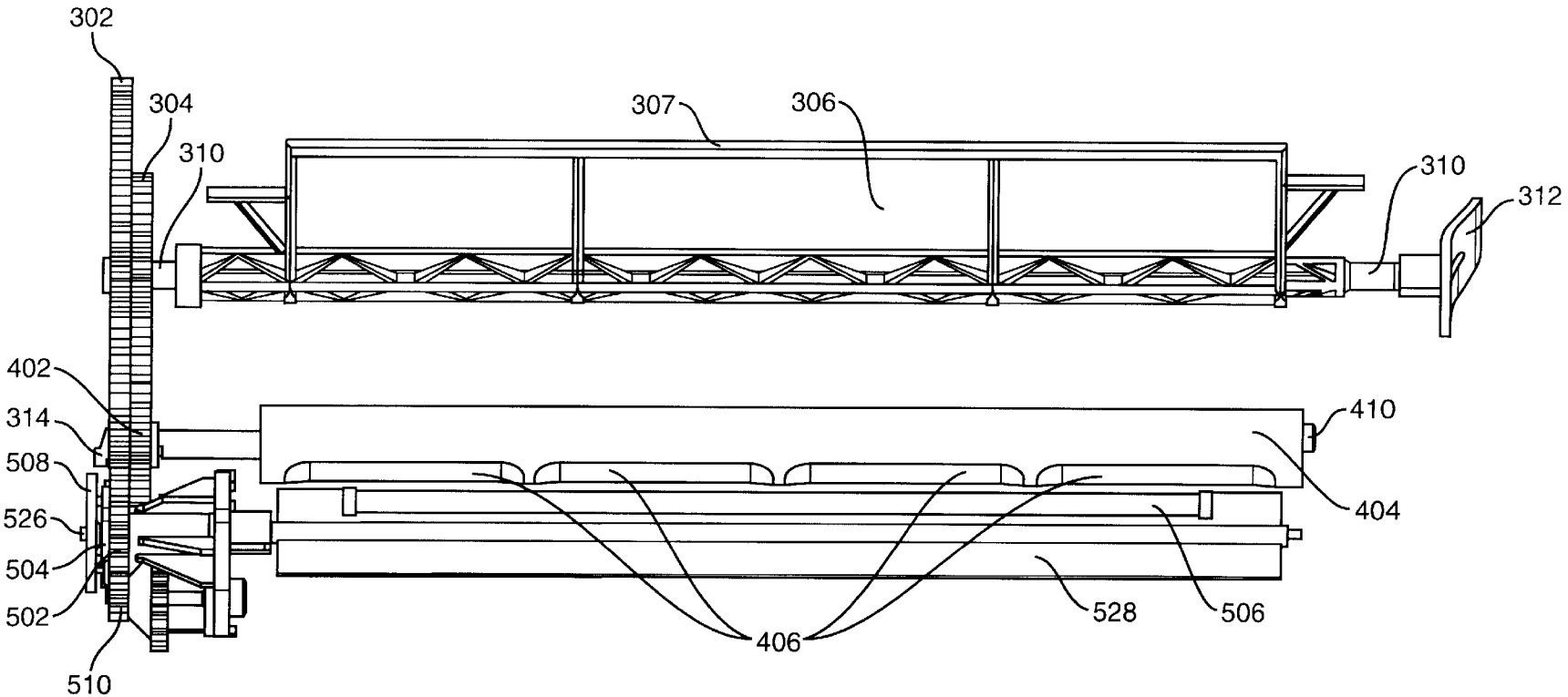
FIG. 6 is a side view illustrating the alignment of the gear mechanisms.
Figure 7:
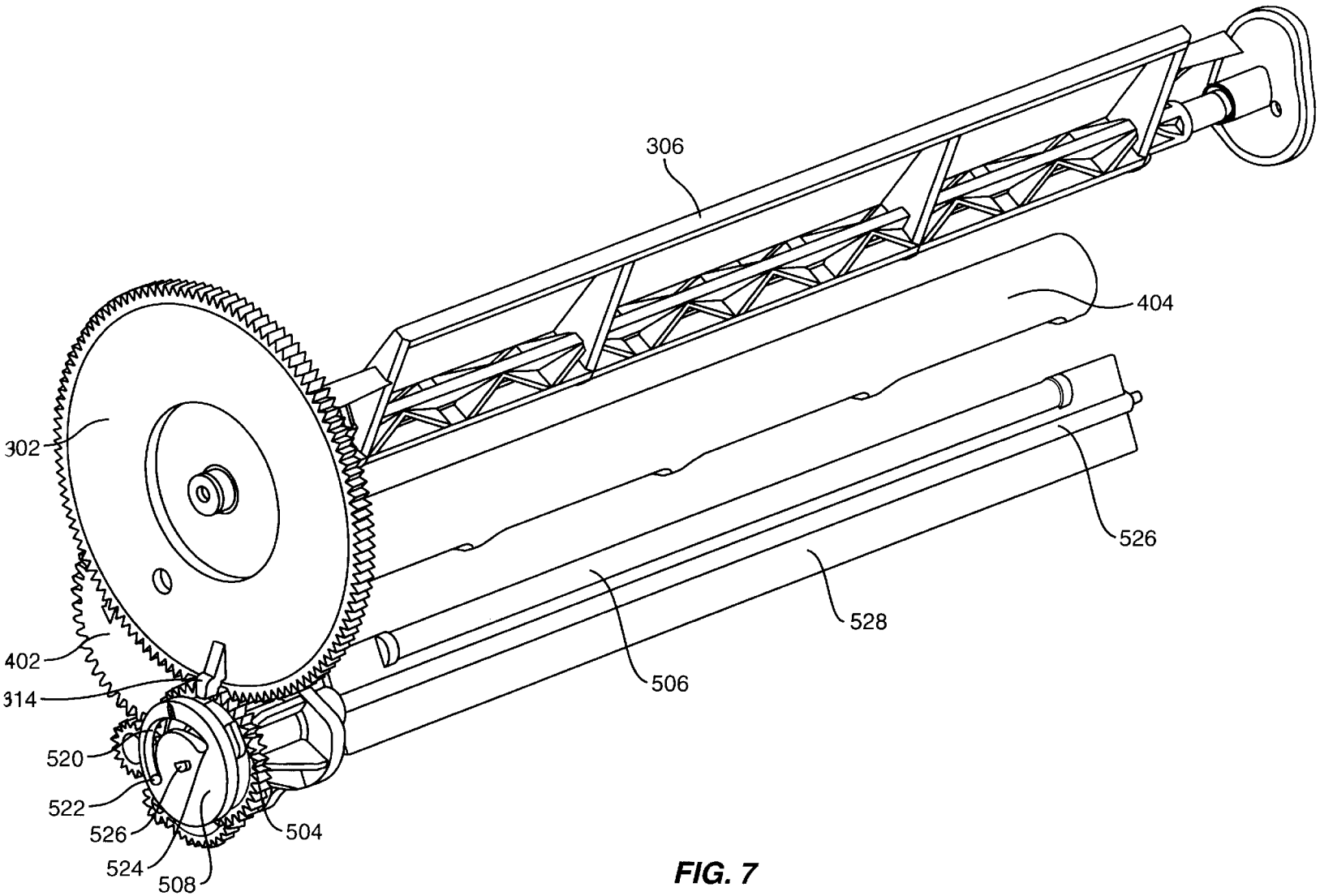
FIG. 7 is a perspective view illustrating of the toner sensing and transferring mechanisms.

The mechanisms for moving the toner from the upper sump region 202 to the lower sump region 204 are illustrated in FIGS. 5–7. These include a toner supply mechanism 300 within the upper sump region 202 for agitating and moving the toner from the upper sump region 202 to the lower sump region 204. A toner sensor mechanism 500 is positioned in the lower sump region 204 for determining the amount of toner within the lower sump 204 and engaging the toner supply mechanism 300 once that level reaches a predetermined amount. A metering mechanism 400 functions to move a specific amount of toner from the upper sump region 202 to the lower sump region 204.

The toner supply mechanism 300 functions to agitate the toner within the upper sump region 202 and move the toner to the metering mechanism 400. The toner within the upper sump region 202 may become packed together and unable to be fed through the toner reservoir ultimately to the photoconductor 114. As illustrated in FIG. 5, the toner supply mechanism 300 includes toner supply gears having a larger outer gear 302 and an inner gear 304. Preferably, the gears 302, 304 are integrally connected. The outer gear 302 and inner gear 304 are both mounted on a central axle 310 that extends through the upper sump region 202 of the cartridge. The outer gear 302 and inner gear 304 are both fixedly attached to the axle 310 thereby rotation of one of the gears results in rotation of both gears.

The inner gear 304 has a smaller diameter than the outer gear 302 and includes inner gear teeth 322 positioned around the circumference. The outer gear 302 includes teeth 316 positioned about the circumference except for an opening 320 that has no teeth. Opening 320 includes an edge 321 positioned nearer to the center of the gear than the inner edges of the gear teeth 316. As illustrated in FIG. 5, a dogleg 314 is fixedly mounted to the outer gear 302 and extends into the opening 320. The end of the dogleg 315 extends into the opening 320 a distance less than the outer edge of the gear teeth 316.

FIG. 6 illustrates a side view of the toner supply mechanism. The wall of the toner bin housing 220 has been removed from FIG. 6 for clarification purposes. The developer housing 220 is placed between the inner gear 304 and paddle 306 such that inner and outer gears 304, 302 do not contact the toner. Likewise on the opposite side, the toner bin housing 220 is positioned between the paddle 306 and cam 312.

The paddle 306 extends substantially the width of the upper sump region 202. The size of the paddle 306 is such that during rotation the outer edge 307 comes within close proximity to the inner walls of the upper sump region 202 for agitating the toner and preventing toner clumping or sticking. The paddle 306 may have a variety of orientations including substantially straight, or including an outer wing 309 substantially perpendicular to the paddle 306 as illustrated in FIG. 5.

The metering mechanism, generally designated 400, is positioned between the upper sump 202 and lower sump 204 regions for moving toner therebetween. As illustrated in FIG. 5, the meter mechanism 400 is substantially aligned with the pass-through region 206 and includes a meter gear 402 having a meter unit 404. Meter gear 402 includes teeth 416 that extend about the circumference. In one embodiment, the meter gear 402 is of the same size as inner gear 304 and has the same number of teeth, therefore, one rotation of the inner gear 304 results in one complete revolution of the meter gear 402. A meter measuring unit 404 is aligned with the meter gear 402 about a central axle 410. The meter measuring unit 404 includes meter openings 406 for collecting and transferring toner from the upper sump region 202 to the lower sump region 204.

FIG. 6 illustrates the alignment and spacing of the meter mechanism 400 relative to the other mechanisms for sensing and moving toner. The toner bin housing 220 extends between the meter gear 402 and meter measuring unit 404 such that the gear does not contact the toner. The meter gear 402 is positioned within the same plane as the inner supply gear 304 and the meter gear teeth 416 intermesh with the inner gear teeth 322. The meter measuring unit is preferably generally cylindrical having a series of meter openings 406 positioned along the length. As the openings 406 rotate through the upper sump region 202, toner drops into the openings and is carried to the lower sump region 204 during the rotation. In one embodiment, the meter openings 406 are positioned vertically downward when not in rotation to ensure the toner within the openings exits and to prevent toner from entering and becoming jammed. Openings 406 are sized to transfer a specified amount of toner and may have smooth, non-abrasive inner surfaces to facilitate dumping the toner into the lower sump region 204. As illustrated in FIG. 6, a series of openings 406 are positioned along the meter measuring unit 404. However, a variety of openings may be positioned along one side of the meter measuring unit 404. The central axle 410 extends from the meter gear 402 through the toner cartridge as illustrated in FIG. 6. The axle 410 may be mounted within the developer housing 220 opposite the meter gear 402 or may extend through an aperture in the developer housing.

The toner sensor mechanism 500 is positioned in the lower sump region 204 as illustrated in FIG. 5. The toner sensor mechanism 500 determines the amount of toner within the lower sump region 204 and activates the meter mechanism 400 and toner supply mechanism 300 in the event the toner level falls below a predetermined amount. The toner sensor mechanism 500 includes a sensor paddle 506 and attached cam mechanism 508, and a drive gear 502 with slideably attached pawl 504.

The drive gear 502 includes teeth 516 extending about the gear circumference as illustrated in FIGS. 5–8. An input gear 510, connected to the printer drive gears via connector 22 intermeshes with the drive gear teeth 516 providing rotation to the drive gear. As illustrated in FIG. 6, the drive gear 502 is on the same plane as the input gear 510 and outer toner supply gear 302.

The cam mechanism 508 is aligned in front of the drive gear 502 as illustrated in FIGS. 5–7. The cam mechanism 508 is attached to a central axle 526 that extends through the toner sensor mechanism and is connected to the sensor paddle 506. The cam mechanism further includes a cam profile 520 having a first end 524 more distant from the central axle 526 than the second end 522.

Figure 8:
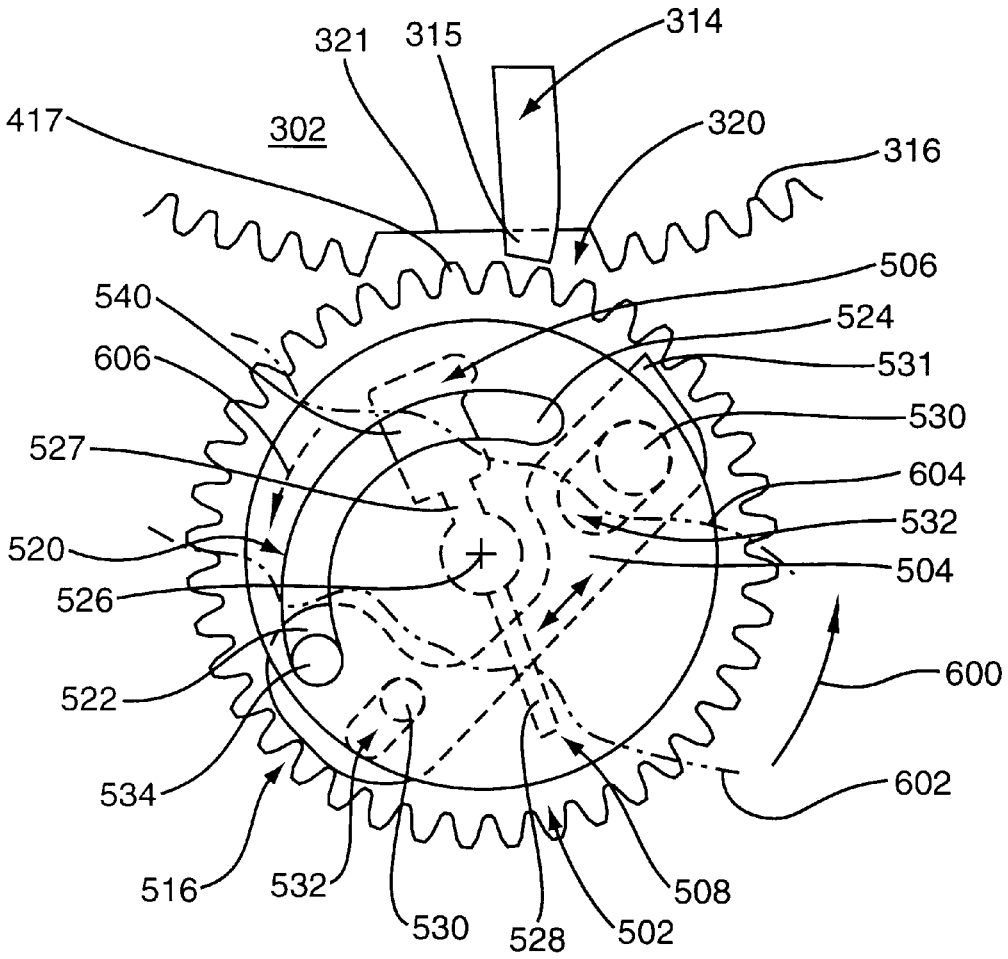
FIG. 8 is an enlarged side view illustrating the interaction between the toner sensor mechanism and the toner supply gears.

As illustrated in FIGS. 5 and 8, posts 530 extend outward from the face of the drive gear 502 towards the cam mechanism 508 for mounting the pawl 504. The pawl 504 may be mounted between the drive gear 502 and the cam mechanism 508, however, other locations are acceptable for positioning the pawl. The pawl 504 includes two elongated openings 532 to receive posts 530 and allow the pawl to slide within the openings relative to the cam mechanism. A boss 534 extends outward from the pawl 504 and is positioned within the cam profile 520.

The sensor paddle 506 is positioned within the lower sump region 204 to the central axle 526 as best illustrated in FIG. 8. The sensor paddle 506 includes a paddle arm 527 and paddle face 540. The paddle face 540 is weighted such that the center of gravity is off-set from the central axle 526.

The sensor paddle 506 and cam mechanism 508 are connected together to rotate at the same speed and orientation. Both are freely rotated by the drive gear 502 defined as providing a rotational force for moving the sensor paddle 506 and cam mechanism 508 from a toner rest point to a fall point at an upper portion of the paddle revolution. However, both the sensor paddle 506 and cam mechanism 508 may rotate at a faster speed during an angular displacement portion of the revolution from the fall point to the toner rest point due to the offset weighting of the paddle. By way of example, when the sensor paddle 506 is positioned at an upper position within the revolution, the offset weighting of the sensor paddle 506 provides for the sensor paddle 506 and cam mechanism 508 to freely rotate ahead or fall forward of the drive gear 502 until the sensor paddle 506 contacts the toner within the lower sump region 204. At the point of rest with the toner, both the cam mechanism 508 and the sensor paddle 506 will lie substantially motionless until the drive gear 502 rotates to the position, or "catches up". At this point, the drive gear 502 will provide a force to rotate the elements through the remainder of the revolution. In one embodiment, the fall point is just beyond the topdead-center point of the revolution, however, other fall positions on the revolution may also be used for determining the angular rotation of the paddle.

An extension 528 can be positioned essentially opposite the sensor paddle 506 to delay the falling of the sensor paddle 506 when the toner level in the lower sump 204 is high. Extension 528 is positioned essentially opposite the offset weight of the sensor paddle 506 and drags in the toner just before the sensor paddle 506 gets to the fall position. When the toner level in the lower sump 204 is high, the force of the toner on the paddle extension 528 delays the fall of the sensor paddle 506. A delay in falling, when the toner level is high, allows the pawl 504 to travel past the dog leg 314 before the pawl 504 can be lifted by the falling sensor paddle 506, thus preventing an unnecessary toner addition cycle. As the drive gear 502 "catches up" to the cam mechanism 508, the pawl 504 is reset to the initial position. This process is continued for each revolution of the sensor paddle 506 and cam mechanism 508.

FIG. 8 illustrates the function of the toner sensor mechanism 500. The toner levels within the lower sump region 204 are illustrated by dotted lines 604 demonstrating a greater amount of toner and line 602 demonstrating a lesser toner amount. The drive gear 502 continuously rotates in the direction indicated by arrow 600 in FIG. 8 due to the intermeshing of the input gear 510, thereby pushing the sensor paddle 506 and cam 508 through continuous revolutions. After the sensor paddle 506 is driven to the fall point, the offset weight of the paddle results in the paddle and cam mechanism rotating faster than the drive gear 502. The sensor paddle 506 will fall ahead of the rotation of the driven gear until the sensor paddle face 540 is stopped by the toner within the lower sump region 204. Once the sensor paddle 506 stops falling, the drive gear 502 catches up to the sensor paddle 506 and cam mechanism 508 and rotates through the complete revolution.

As the cam mechanism 508 rotates in the direction illustrated by arrow 606, the cam profile 520 pushes the pawl boss 534 radially inward towards the central axle 526. This movement results in the elongated openings 532 sliding along the posts 530 and pawl end 531 moving radially outward from the center of the pawl.

Figure 9:
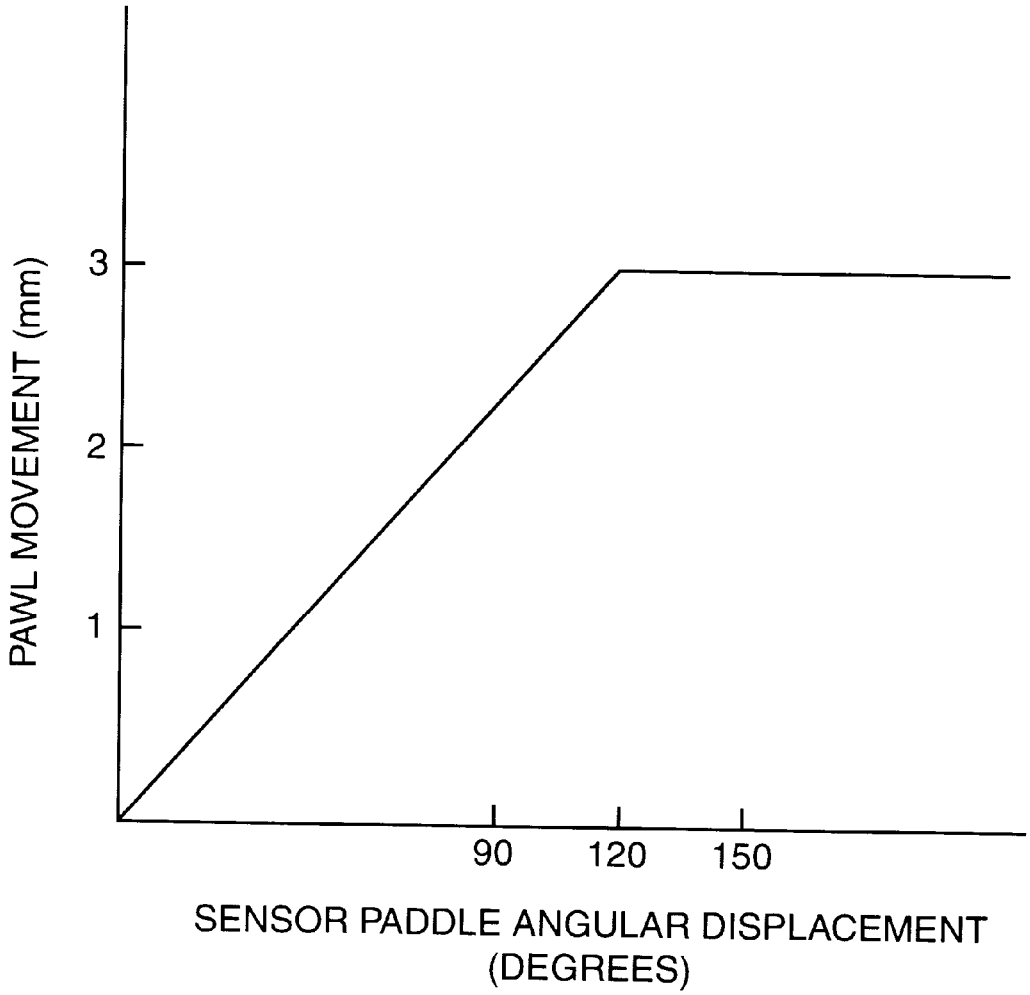
FIG. 9 is a graph illustrating the movement of the pawl relative to the angular displacement of the sensor paddle.

The larger the angular displacement of the sensor paddle 506 from the fall point to the toner rest point, the further the cam mechanism and cam profile pushes pawl end 531 radially outward from the central axle 526. FIG. 9 illustrates the pawl movement relative to the angular displacement of the sensor paddle 506. The pawl movement is dictated by the dimensions of the cam profile 520. In the embodiment illustrated in FIG. 9, the pawl begins to radially move outward upon any angular displacement of the sensor paddle 506 ahead of the driven gear. At an angular displacement of about 120 degrees relative to fall point, the pawl displacement is maximized. It will be understood by one of skilled in the art that the amount of pawl movement and degree of angular displacement can be adjusted depending upon the specific parameters of the printer.

The pawl 504 is driven by the cam mechanism 508 into contact with the dogleg 314 of the outer toner supply gear to move toner from the upper sump region 202 to the lower sump region 204. As illustrated in FIGS. 6 and 7, the pawl 504 is within the same plane as the dog leg 314 to provide for contact upon a predetermined amount of pawl movement relative to the cam 508.

As illustrated in FIG. 8, the outer toner supply gear 302 is positioned relative to the drive gear 502 such that the opening 320 in the teeth of the outer toner supply gear is adjacent to the drive gear teeth 516. Rotation of the drive gear 502 does not translate to the outer toner supply gear 302 because the opening 320 does not provide for the teeth of the two gears to intermesh and the dog leg 314 is positioned above the edge of the drive gear teeth.

When an adequate amount of toner is supplied within the lower sump region such as that illustrated by toner level line 606, the amount of angular displacement of the sensor paddle 506 results in a minimal amount of radial movement of the pawl. Thus, there is no contact when the pawl end 531 rotates past the dog leg 314. As the printer 100 continues to print images, the amount of toner passed between the developer roll 124 and doctor blade 210 reduces the toner level. Eventually, the toner level will decrease to a level such as that illustrated by line 602. At this position, the sensor paddle 506 will have an angular displacement ahead of the driven gear an adequate amount resulting in the pawl end 531 contacting the dog leg 314.

As the pawl end 531 contacts the dog leg 314, the pawl transfers rotation to the outer toner supply gear until the drive gear teeth 516 mesh with the outer toner supply gear teeth 316. This results because the drive gear 502 and the outer toner supply gear 302 are positioned within the same place as illustrated in FIG. 6. The continuous rotation of the drive gear 502 will result in one complete rotation of the outer toner supply gear 302 until the opening 320 is again positioned adjacent to the driven gear teeth 316 and the process stops.

Rotation of the outer supply gear 302 translates to rotation of the inner supply gear 304. Rotation of the inner supply gear 304 results in rotation of the meter gear 402. The toner meter openings 406 are positioned away from the upper sump region 202 when not rotating to prevent toner from entering the openings and possibly becoming packed within and stuck in the openings. During rotation of the meter gear 402, the openings rotate through the upper sump region 202 and gather toner. In this embodiment the meter openings 406 face into the upper sump region 202 when the toner supply paddle 306 is positioned directly adjacent the openings 406 to ensure an adequate amount of toner enters the openings. Upon rotation of the meter gear 402, the toner within the openings 406 is discharged via gravity into the lower sump region 204. One rotation of the outer toner supply gear 302 may result in more than one rotation of the meter gear 402. By way of example as illustrated in FIG. 5, one rotation of the outer toner supply gear 302 results in one rotation of the meter gear 402 and, thereby one toner load being moved from the upper sump region 202 to the lower sump region 204. The correlation between size of the gears and the number of rotations of the openings 406 will vary depending upon the parameters of the printer. In one embodiment, upon complete rotation of the outer toner supply gear 302, the openings 406 are in a downward facing position to allow for all the toner to exit the openings.

Once the outer toner supply gear 302 completes a full rotation and the opening 320 is positioned adjacent to the drive gear 502, there may be teeth chatter resulting from the drive gear teeth 516 contacting the last tooth on the toner supply gear 302. To prevent this chatter, in one embodiment at least one tooth 417 on the drive gear 502 has a greater length than the other teeth to push the last tooth of the toner supply gear 302 beyond the contact with the gear teeth 516. The large tooth 417 only moves the last tooth of 302 a small distance still allowing for the pawl 504 to contact the dog leg when additional toner is required in the lower sump region 204. A back check can also be used to prevent gear 302 from traveling back into contact with drive gear 502.

This process of adding toner as needed to the lower sump region 204 continues until all the toner within the cartridge is consumed. At that point, a new cartridge is required. In one embodiment, the toner within the lower sump region is transferred to the photoconductor 114 before the additional toner is added from the upper sump region 204. This first in-first out format has proven effective in maintaining good print quality. Also, the toner sensor mechanism 500 is calibrated such that additional toner is transferred to the lower sump region 204 prior the occurrence of print defects or other quality problems.

In the foregoing description, like-reference characters designate like or corresponding parts throughout the several views. Also, it is to be understood that such terms as "forward", "rearward", "left", "right", "upwardly", "downwardly", and the like are words of convenience that are not to be construed as limiting terms. Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A device for containing toner within an image forming apparatus comprising:

a. a first reservoir;

b. a second reservoir connected to said first reservoir;

c. a toner sensor mechanism for determining the amount of toner in the second reservoir, said toner sensor including a sensor paddle mounted to rotate about an axis within said second reservoir; and d. a meter responsive to said toner sensor mechanism to transfer toner from said first reservoir to said second reservoir when the toner level in the second reservoir drops below a predetermined level.

2. The device of claim 1, wherein said sensor paddle freely rotates through an angular displacement from a fall point and a toner rest point, and wherein said meter is activated based upon the angle of free rotation of said sensor paddle.

3. The device of claim 1, further including a toner supply mechanism connected to said meter to agitate and move the toner from the first reservoir to the second reservoir.

4. The device of claim 3, wherein said toner supply mechanism comprises a paddle positioned within said first reservoir for agitating and moving toner within said first reservoir.

5. The device of claim 1, further comprising a pass-through region positioned between said first and second reservoirs to contain toner being transferred between said first and second reservoirs.

6. The device of claim 1, wherein said first reservoir is positioned vertically above said second reservoir.

7. The device of claim 1, wherein said meter comprises at least one opening to contain a predetermined amount of the toner being transferred from said first reservoir to said second reservoir, said at least one opening being positioned away from said first reservoir when not in use.

8. The device of claim 1, wherein said device is contained within a cartridge that is removable from the image forming apparatus.

9. The device of claim 1, wherein said first reservoir may store a larger amount of toner than said second reservoir.

10. The device of claim 9, wherein the toner within said second reservoir is substantially removed before toner is added from said first reservoir.

11. The device of claim 2, wherein said toner sensor mechanism further comprises a continuously rotating drive gear having gear teeth positioned about said drive gear circumference.

12. The device of claim 11, wherein said sensor paddle is contacted by said drive gear such that the sensor paddle makes one revolution through said second reservoir for each revolution of the drive gear.

13. The device of claim 12, wherein said sensor paddle comprises a paddle face substantially offset from said axis, said sensor paddle being weighted to provide a center of gravity offset from said axis allowing for said sensor paddle to fall ahead of said drive gear at said fall point.

14. The device of claim 13, further including a cam mechanism with a cam profile and a pawl, said cam mechanism rotating ahead of said drive gear an amount equal to said angular displacement, said pawl having a cam follower positioned within said cam profile such that said pawl is radially displaced by rotation of said cam mechanism ahead of said drive gear.

15. The device of claim 14, wherein upon cam mechanism rotation ahead of said drive gear by a predetermined amount, said pawl is displaced a proportional amount to activate said meter to feed the toner from said first reservoir to said second reservoir.

16. A device for determining the amount of toner stored within a reservoir of an image forming apparatus comprising:

a. a drive gear rotating about an axis of rotation;

b. a sensor paddle rotating in the reservoir about said axis of rotation; and c. a pawl mounted to said drive gear having radial movement between extended and retracted positions, the amount of radial movement of said pawl being dependent on an angular displacement of said sensor paddle relative to said drive gear.

17. The device of claim 16, further comprising a cam mechanism connected to said sensor paddle and rotating about said axis of rotation, said cam mechanism and said sensor paddle having the same relative angular displacement to said drive gear.

18. The device of claim 17, wherein said pawl is connected to said cam mechanism and said angular displacement of said cam mechanism radially displaces said pawl.

19. The device of claim 18, wherein said drive gear comprises at least one outwardly extending post and said pawl comprises at least one elongated opening mounted over said post to connect said pawl to said drive gear.

20. The device of claim 16, wherein said sensor paddle rotates through the reservoir at the same average speed as said drive gear.

21. The device of claim 16, wherein said sensor paddle is freely attached to said drive gear providing for a revolution in which said sensor paddle falls ahead of said drive gear from a fall point to a toner rest point and is driven by said drive gear during a remainder of the revolution, said toner rest point being determined by a toner amount in said reservoir.

22. The device of claim 21, wherein said sensor paddle is weighted to have a center of gravity offset from said axis of rotation allowing for said sensor paddle to fall ahead of said drive gear at said fall point to said toner rest point.

23. The device of claim 22, wherein sensor paddle weight torque is greater than a pivot friction of said sensor paddle.

24. The device of claim 22, further including an extension on said sensor paddle positioned substantially opposite the center of gravity of said sensor paddle, said extension delaying the fall of said sensor paddle when the reservoir contains a predetermined toner amount.

25. The device of claim 17, wherein said sensor paddle is positioned within the reservoir and said drive gear, cam mechanism, and pawl are positioned outside the reservoir.

26. The device of claim 16, wherein upon a predetermined angular displacement, said pawl is displaced to said extended position to activate a toner supply mechanism to feed additional toner into the reservoir.

27. The device of claim 16, wherein the device is mounted within a color laser printer.

28. A mechanism for supplying toner within an image forming apparatus comprising:

a. a rotating drive gear having drive gear teeth extending about the circumference;

b. a toner supply gear positioned adjacent to said drive gear and having toner supply gear teeth extending about a portion of the circumference and a portion of the circumference forming an opening having no toner supply gear teeth;

c. a dog leg attached to said toner supply gear adjacent said opening; and d. a pawl mounted to said drive gear to move radially between extended and retracted positions, said pawl contacts said dog leg at said extended position to rotate said toner supply gear to allow said drive gear teeth to intermesh with said toner supply gear teeth.

29. The mechanism of claim 28, wherein rotation of said toner supply gear causes toner to be transferred from a first reservoir to a second reservoir.

30. The mechanism of claim 29, wherein said opening is positioned adjacent to said drive gear when said second reservoir has a supply of toner.

31. The mechanism of claim 28, wherein said drive gear and said toner supply gear are aligned within the same plane.

32. The mechanism of claim 28, wherein said pawl and said dog leg are aligned within the same plane.

33. The mechanism of claim 28, wherein said toner supply gear teeth intermesh with said drive gear teeth.

34. The mechanism of claim 33, wherein at least one of said drive gear teeth is longer thereby rotating said toner supply gear such that said opening is positioned adjacent to said drive gear to prevent teeth chatter between said supply gear and said drive gear.

35. The mechanism of claim 34, wherein said dog leg extends outward from said toner supply gear a distance less than said toner supply gear teeth.

36. The mechanism of claim 29, further including a meter gear connected to said toner supply gear, said meter gear having a meter unit to collect a specific amount of the toner from said first reservoir and transferring the toner to said second reservoir.

37. The mechanism of claim 36, wherein said meter gear comprises meter gear teeth that intermesh with said toner supply gear teeth.

38. The mechanism of claim 37, wherein said toner supply gear comprises an outer gear having outer gear teeth to intermesh with said drive gear teeth and an inner gear having inner gear teeth to intermesh with said meter gear teeth.

39. The mechanism of claim 36, wherein an opening within said meter gear is positioned away from said first reservoir when not being rotated.

40. A device for storing toner within an image forming apparatus comprising:

a. an upper reservoir;

b. a lower reservoir connected to said upper reservoir;

c. a sensor paddle positioned within said lower reservoir to determine a toner level within said lower reservoir, said sensor paddle having an angular displacement from a fall point to a toner rest point;

d. a drive gear to rotate said sensor paddle;

e. a cam mechanism connected to said sensor paddle and positioned adjacent to said drive gear, said cam mechanism has a cam angular displacement relative to said drive gear about equal to said sensor paddle angular displacement relative to said drive gear; and f. a pawl movably connected to said drive gear, said pawl further comprising a boss;

upon a predetermined angular displacement of said sensor paddle and said cam mechanism relative to said drive gear, said boss on said pawl follows said cam resulting in said pawl radially extending outward from said drive gear to transfer toner from said upper reservoir to said lower reservoir.

41. The device of claim 40, further comprising a doctor blade and developer roller positioned within said lower reservoir to transfer the toner to the image forming apparatus.

42. The device of claim 40, wherein said toner rest point and angular displacement vary depending upon the toner within said lower reservoir.

43. A device for determining the amount of toner within an image forming apparatus comprising:

a. a reservoir containing toner;

b. an elongated paddle rotating within said reservoir about a first axis such that said paddle rotates through the toner in the reservoir during at least a portion of its revolution;

c. a drive mechanism configured to drive said paddle through a portion of its revolution from a toner rest point to a fall point, wherein said paddle rotates forward freely from said fall point to said toner rest point; and d. a pawl mechanism mounted to said drive mechanism and configured to extend radially outward from said drive mechanism proportional to an amount said paddle rotates forward from said fall point to said toner rest point.

44. The device of claim 43, wherein said drive mechanism is further adapted to reengage said paddle at said toner rest point and rotate said paddle forward to said fall point.

45. The device of claim 43, wherein said paddle has a weighted end offset from said first axis to provide for said paddle to move ahead of said drive mechanism from said fall point to said toner rest point.

46. The device of claim 43, wherein said pawl resets to an initial position after each revolution of said paddle.

47. The device of claim 45, wherein said paddle includes an extension positioned essentially opposite said weighted end to delay the fall of said paddle when the toner in said reservoir is greater than a predetermined level.

48. A toner supply device for supplying toner within an image forming mechanism comprising:

a. a first toner reservoir;

b. a second reservoir integral with said first toner reservoir;

c. an elongated paddle rotating within said second reservoir about a first axis such that said paddle rotates through the toner in said second reservoir during at least a portion of its revolution;

d. a drive mechanism configured to drive said paddle through a portion of its revolution from a toner rest point to a fall point, wherein said paddle rotates forward freely from said fall point to said toner rest point; and e. a toner supply means for transferring toner from said first reservoir to said second reservoir upon the toner reaching a predetermined level within said second reservoir.

49. A method for determining the amount of toner within a reservoir of an image forming apparatus comprising the steps of:

a. rotating a sensor paddle within the reservoir such that the sensor paddle freely rotates from a fall point to a toner rest level;

b. determining an angular displacement of said of the sensor paddle; and c. activating a toner supply mechanism when the sensor paddle rotates through a predetermined angular displacement.

50. A method of supplying toner within an image forming apparatus from a first reservoir to a second reservoir, said method comprising the steps of:

a. rotating a sensor paddle within the second reservoir for determining a toner level;

b. monitoring an angular displacement of the sensor paddle from a fall point to a toner rest point;

c. radially moving an arm a distance proportional to the angular displacement;

d. contacting the arm with a toner supply mechanism upon a predetermined angular displacement; and e. transferring toner via the toner supply mechanism from the first reservoir to the second reservoir.

* * * * *